US009394666B2

(12) United States Patent
Oka

(10) Patent No.: US 9,394,666 B2
(45) Date of Patent: Jul. 19, 2016

(54) CONSTRUCTION MACHINE WITH WORKING ATTACHMENT

(75) Inventor: Hidekazu Oka, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 336 days.

(21) Appl. No.: 14/001,463

(22) PCT Filed: Jan. 31, 2012

(86) PCT No.: PCT/JP2012/000612

§ 371 (c)(1),
(2), (4) Date: Aug. 23, 2013

(87) PCT Pub. No.: WO2012/114654

PCT Pub. Date: Aug. 30, 2012

(65) Prior Publication Data

US 2013/0330160 A1 Dec. 12, 2013

(30) Foreign Application Priority Data

Feb. 24, 2011 (JP) ..... 2011-038642

(51) Int. Cl.
*F15B 21/14* (2006.01)
*E02F 3/43* (2006.01)
(Continued)

(52) U.S. Cl.
CPC . *E02F 3/435* (2013.01); *E02F 3/30* (2013.01); *E02F 9/2029* (2013.01);
(Continued)

(58) Field of Classification Search
CPC ..... F15B 21/14; F15B 2211/40509; F15B 2211/88; F15B 2211/41509
See application file for complete search history.

(56) References Cited

U.S. PATENT DOCUMENTS 5,168,705 A 12/1992 Hirata et al.
5,571,226 A 11/1996 Kobayashi
(Continued)

FOREIGN PATENT DOCUMENTS

CN 1109950 A 10/1995
CN 1676785 A 10/2005
(Continued)

OTHER PUBLICATIONS

Office Action and Search Report issued on Jan. 21, 2015 in the corresponding Chinese Patent Application No. 201280010329.5 (with English Summary and Translation of Category of Cited Documents).
(Continued)

*Primary Examiner* — F. Daniel Lopez
(74) *Attorney, Agent, or Firm* — Oblon, McClelland, Maier & Neustadt, L.L.P

(57) ABSTRACT

A construction machine, including: a hydraulic pump; a working attachment including a boom, a boom cylinder, and another fluid-supplied cylinder closer to a leading end than the boom cylinder; first and second operation devices for the boom cylinder and the fluid-supplied cylinder; first and second control valves; a flow-rate-limiting section; and an anti-cavitation circuit. The fluid-supplied cylinder receives fluid-supply from the hydraulic pump, together with the boom cylinder. A reaction force upon work accompanying extension of the fluid-supplied cylinder increases the rod-side pressure of the boom cylinder and reduces a head-side pressure. The flow-rate-limiting section limits a supply flow rate to a head-side fluid chamber of the boom cylinder only during a boom-raising-operation with the rod-side pressure higher than the head-side pressure in the boom cylinder. The anti-cavitation circuit replenishes hydraulic fluid from a tank to the head-side fluid chamber.

8 Claims, 6 Drawing Sheets

(51) Int. Cl.
*E02F 9/22* (2006.01)
*E02F 3/30* (2006.01)
*E02F 9/20* (2006.01)

(52) U.S. Cl.
CPC ..... *E02F 9/2203* (2013.01); *E02F 9/226* (2013.01); *E02F 9/2228* (2013.01); *E02F 9/2282* (2013.01); *E02F 9/2285* (2013.01); *F15B 21/14* (2013.01); *F15B 2211/3116* (2013.01); *F15B 2211/329* (2013.01)

(56) References Cited

U.S. PATENT DOCUMENTS

| | | | | |
|---|---|---|---|---|
| 6,389,953 | B1 | 5/2002 | Altman et al. | |
| 6,502,393 | B1 * | 1/2003 | Stephenson | F15B 11/006 60/414 |
| 6,880,332 | B2 * | 4/2005 | Pfaff | F15B 11/006 60/422 |
| 2005/0144938 | A1 | 7/2005 | Kajita et al. | |
| 2005/0229594 | A1 | 10/2005 | Nanjo et al. | |
| 2007/0028607 | A1 | 2/2007 | Ishikawa et al. | |

FOREIGN PATENT DOCUMENTS

| | | |
|---|---|---|
| CN | 1774548 A | 5/2006 |
| JP | 2011 17135 | 1/2011 |
| WO | 2004 005727 | 1/2004 |

OTHER PUBLICATIONS

International Search Report Issued May 1, 2012 in PCT/JP12/000612 filed Jan. 31, 2012.

* cited by examiner

PRIOR ART

PRIOR ART

CONSTRUCTION MACHINE WITH WORKING ATTACHMENT

TECHNICAL FIELD

The present invention relates to a construction machine with a working attachment, such as a hydraulic shovel or the like.

BACKGROUND ART

In a construction machine provided with a working attachment, wherein the working attachment has a boom, an arm, a working device, a boom cylinder for driving the boom, an arm cylinder for driving the arm, and a working cylinder for driving the working device, a reaction force upon operation acts on the working attachment in such a direction as to extend the boom cylinder, thereby causing a possibility of increasing pressure in a rod-side fluid chamber of the boom cylinder (hereafter, rod-side pressure) and decreasing pressure in a head-side fluid chamber (hereafter, head-side pressure).

This will be explained taking a typical hydraulic shovel shown in FIG. 5 as an example. The hydraulic shovel includes a crawler-type lower traveling body 1 and an upper slewing body 2 installed on the lower traveling body 1 so as to be slewable about an axis perpendicular to the ground. The upper slewing body 2A is attached with an attachment 9. The working attachment 9 has a boom 3, an arm 4, a bucket 5 which is a working device, a boom cylinder 6 that drives the boom 3, an arm cylinder 7 that drives the arm 4, and a bucket cylinder 8 that drives the bucket 5. The working attachment 9 performs various kinds of work such as excavation, loading, leveling and the like as a result of a single operation or compound operation of raising/lowering of the boom 3, pushing/retracting of the arm 4, i.e. upward/downward pivoting, and excavation (scooping) and return of the bucket 5.

FIG. 6 shows a conventional hydraulic circuit for driving the boom cylinder 6 and the arm cylinder 7. The hydraulic circuit includes: a boom remote control valve 10 and an arm remote control valve 11 for operating the boom cylinder 6 and the arm cylinder 7, respectively; a boom control valve 12 and an arm control valve 13 which are respective hydraulic-pilot-operated selector valves adapted to be operated by receiving pilot pressure outputted by the remote control valves 10, 11; and a tank T and a hydraulic pump 14 which are connected to the boom cylinder 6 and the arm cylinder 7 via the control valves 12, 13, respectively.

The boom control valve 12, which is a control valve for the boom cylinder 6, has a neutral position 12*n*, a boom raising position 12*a* and a boom lowering position 12*b*, and is adapted to be switched between these positions to thereby enable the supply and discharge of pressure fluid to/from the boom cylinder 6 to be controlled. Similarly, the arm control valve 13, which is a control valve for the arm cylinder 7, has a neutral position 13*n*, an arm retracting position 13*a* and an arm pushing position 13*b*, and is adapted to be switched between the positions to thereby enable the supply and discharge of pressure fluid to/from the arm cylinder 7 to be controlled. The boom cylinder 6 has a head-side (extension-side) fluid chamber 6*a* and a rod-side fluid chamber 6*b*, and the arm cylinder 7 has a head-side (extension-side) fluid chamber 7*a* and a rod-side fluid chamber 7*b*.

During excavation work by the hydraulic shovel through an arm retracting operation alone of the arm 4, an excavation reaction force acting on the working attachment 9 increases the pressure inside the circuits pertaining to the arm cylinder 7 and acts on the boom 3 upward (in the direction of extending the boom cylinder 6) to increase the rod-side pressure of the boom cylinder 6, i.e. the pressure in the rod-side fluid chamber 6*b*, and decrease the pressure in the head-side pressure, i.e. the pressure in the head-side fluid chamber 6*a*. This excavation reaction force brings the vehicle body into a raised state to render the continuation of the excavation work impossible.

To avoid such an occurrence, ordinarily performed is a boom raising operation in order to relieve the rod-side pressure of the boom cylinder 6 and an operation of letting out the fluid in the rod-side fluid chamber 6*b* to the tank T via the boom control valve 12. In short, performed is an arm retracting/boom raising compound operation. This operation reduces the rod-side pressure to thereby enable the boom cylinder 6 to bear the excavation reaction force, allowing the excavation work to be continued.

However, the operation of the boom control valve 12 to the boom raising position 12*a* causes a meter-in opening and a meter-out opening of the valve 21 to be opened simultaneously, thus allowing a discharge fluid from the hydraulic pump 14 to be flowed into the head-side fluid chamber 6*a* of the low-pressure boom cylinder 6, that is, allowing the discharge fluid to be supplied to the boom cylinder 6 which essentially requires no fluid. This brings not only energy loss in the circuit but also reduction in the supply amount of the discharge fluid to the arm cylinder 7 (including other hydraulic cylinders such as the bucket cylinder 8 in a case where these other hydraulic cylinders are connected to the hydraulic pump 14) that is driven by the same discharge fluid to reduce power in the arm 4, thereby impairing work efficiency.

The increase in the rod-side pressure and the reduction in the head-side pressure in the boom cylinder 6 occur not only during an arm retracting/boom raising compound operation but also during a compound operation of scooping by the bucket 5 and boom raising for relieving the excavation reaction force derived from scooping. Not limited to the time when the excavation work is performed by the hydraulic shovel, for instance, also when a demolition work is performed by a demolition machine in which an opening and closing-type crushing device called a "nibbler" is attached, in place of the bucket 5, to the leading end of the arm 4, a reaction force during the work can act on the boom cylinder 6 in the direction of extending the cylinder 6, involving the increase in the rod-side pressure and the reduction in the head-side pressure.

As an approach for solving the above problem, Patent Document 1 discloses an art of relieving a rod-side pressure to the head-side fluid chamber of the arm cylinder in a situation of the increase in the rod-side pressure of the boom cylinder and the reduction in the head-side pressure by an excavation reaction force. The art, however, involves narrowing a return passage to a tank from the rod-side fluid chamber of the boom cylinder in order to increase the rod-side pressure of the boom cylinder up to a pressure that can be used as the head-side pressure of the arm cylinder; this gives rise to an adverse effect of generating surplus rod-side pressure in the boom cylinder, upon the extension of the boom cylinder for a work such as horizontal dragging, to increase pressure loss.

Patent Document 1: WO 2004/005727

SUMMARY OF THE INVENTION

It is an object of the present invention to provide a construction machine having a working attachment which includes a boom, a boom cylinder and another hydraulic cylinder, the construction machine being capable of curtailing the supply of discharge fluid from a hydraulic pump to a head-side fluid chamber of the boom cylinder to secure required flow rate at the another hydraulic cylinder while relieving a rod-side pressure of the boom cylinder without incurring significant pressure loss when a reaction force acting on the working attachment as a result of a boom raising operation increases the rod-side pressure and reduce the head-side pressure of the boom cylinder.

The construction machine provided by the present invention comprises: a lower traveling body; an upper slewing body installed on the lower traveling body so as to be slewable; a tank which stores hydraulic fluid; a hydraulic pump which discharges hydraulic fluid from the tank; a working attachment attached to the upper slewing body and having a boom, an arm attached to a leading end of the boom, a working device attached to a leading end of the arm, a boom cylinder which actuates the boom, an arm cylinder which actuates the arm, and a working cylinder which actuates the working device, at least one cylinder of the arm cylinder and the working cylinder which are positioned closer to a leading end of the working attachment than the boom cylinder being a fluid-supplied cylinder which receives a supply of hydraulic fluid from the hydraulic pump, together with the boom cylinder, the attachment being arranged so as to receive a reaction force during work involving extension of the fluid-supplied cylinder, the reaction force acting in a direction of raising the boom to thereby increase a rod-side pressure of the boom cylinder and reduce a head-side pressure thereof; a first operation device which is operated to move the boom cylinder; a second operation device which is operated to move the fluid-supplied cylinder; a first control valve which operates in response to the operation of the first operation device to control a motion of the boom cylinder; a second control valve which operates in response to the operation of the second operation device to control a motion of the fluid-supplied cylinder; a flow-rate-limiting section which limits a supply flow rate from the hydraulic pump to a head-side fluid chamber of the boom cylinder, only when an operation for raising the boom is performed in a situation where the rod-side pressure of the boom cylinder is higher than the head-side pressure thereof; and an anti-cavitation circuit for replenishing the head-side fluid chamber of the boom cylinder with hydraulic fluid from the tank.

EMBODIMENTS FOR CARRYING OUT THE INVENTION

Figure 1:
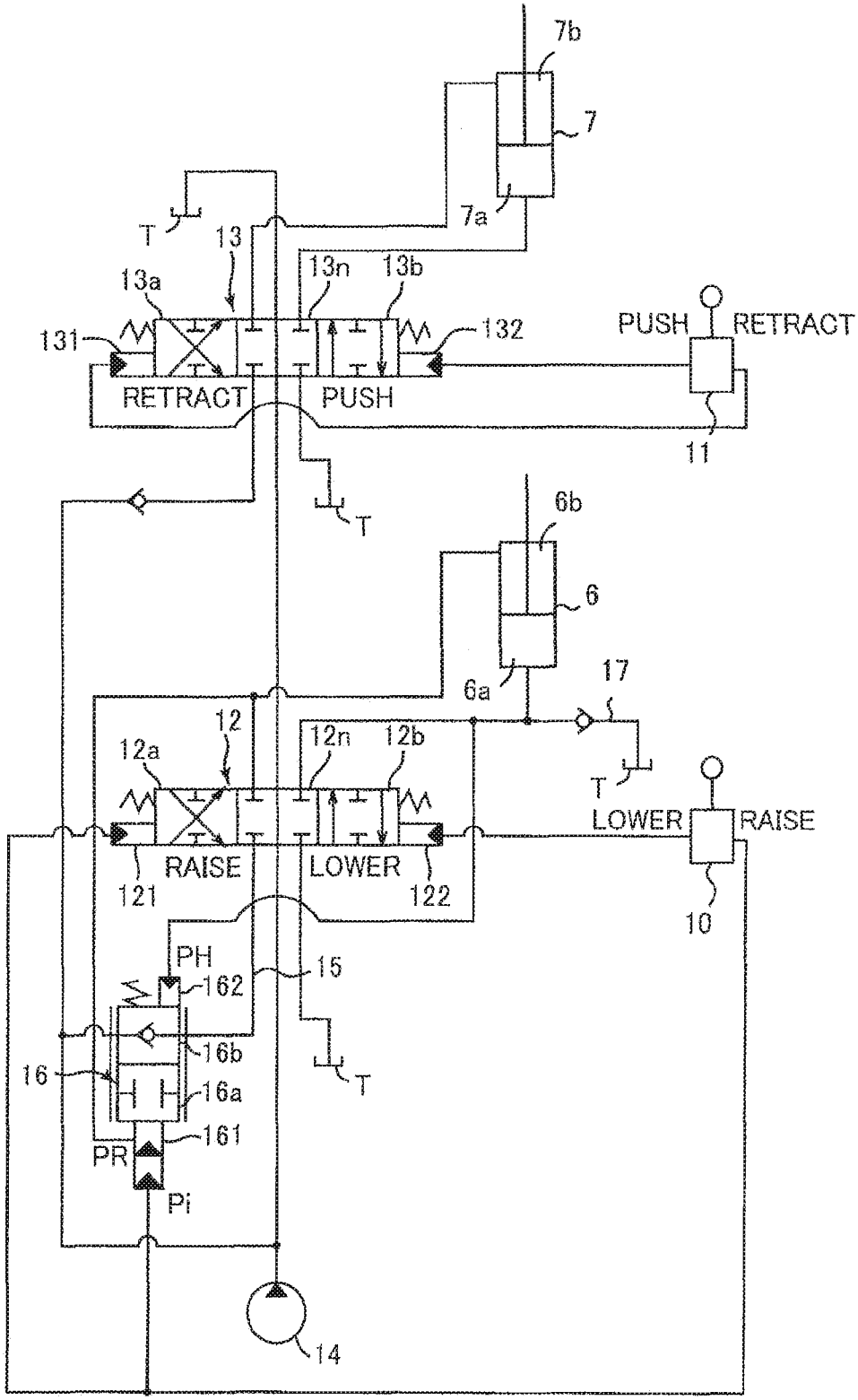
FIG. 1 is a diagram showing a hydraulic circuit according to a first embodiment of the present invention.

There will be explained embodiments of the present invention with reference to accompanying drawings. In each of the embodiments, the invention is applied to a hydraulic shovel such as the one shown in FIG. 5, the hydraulic shovel comprising a lower traveling body 1, an upper slewing body 2 and a working attachment, wherein the working attachment has a boom 3, an arm 4 attached to the leading end of the boom 3, a bucket 5, as a working device, attached to the leading end of the arm 4, a boom cylinder 6 which actuates the boom 3, an arm cylinder 7 which actuates the arm, and a bucket cylinder 8 as a working cylinder which actuates the bucket 5. Respective hydraulic circuits shown in FIG. 1 to FIG. 3 corresponds to the first through third embodiments, each installed in the hydraulic shovel. The embodiments will be explained taking a control during excavation work by a compound operation of arm retracting/boom raising as explained in the section on Background Art, as an example.

Figure 2:
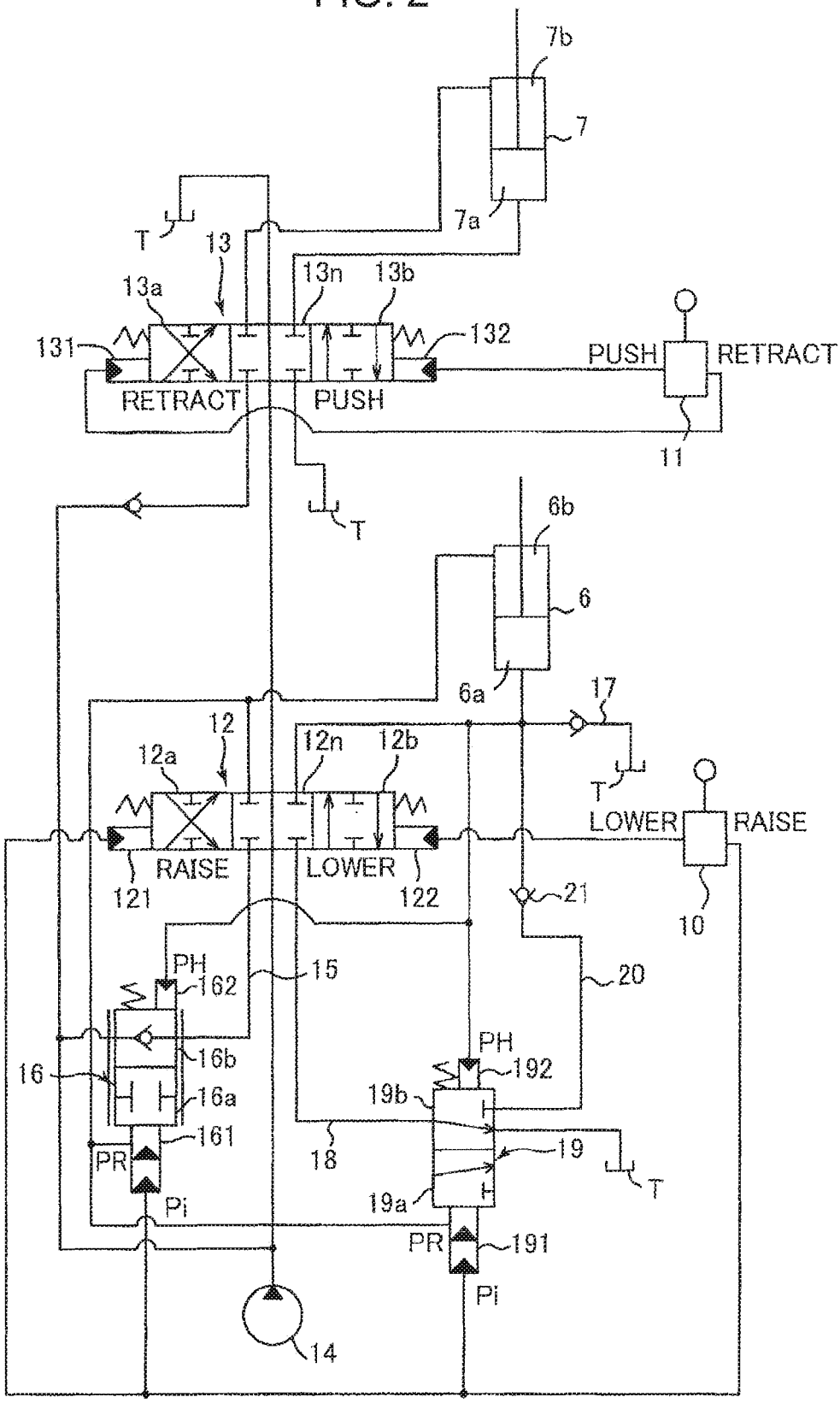
FIG. 2 is a diagram showing a hydraulic circuit according to a second embodiment of the present invention.
Figure 3:
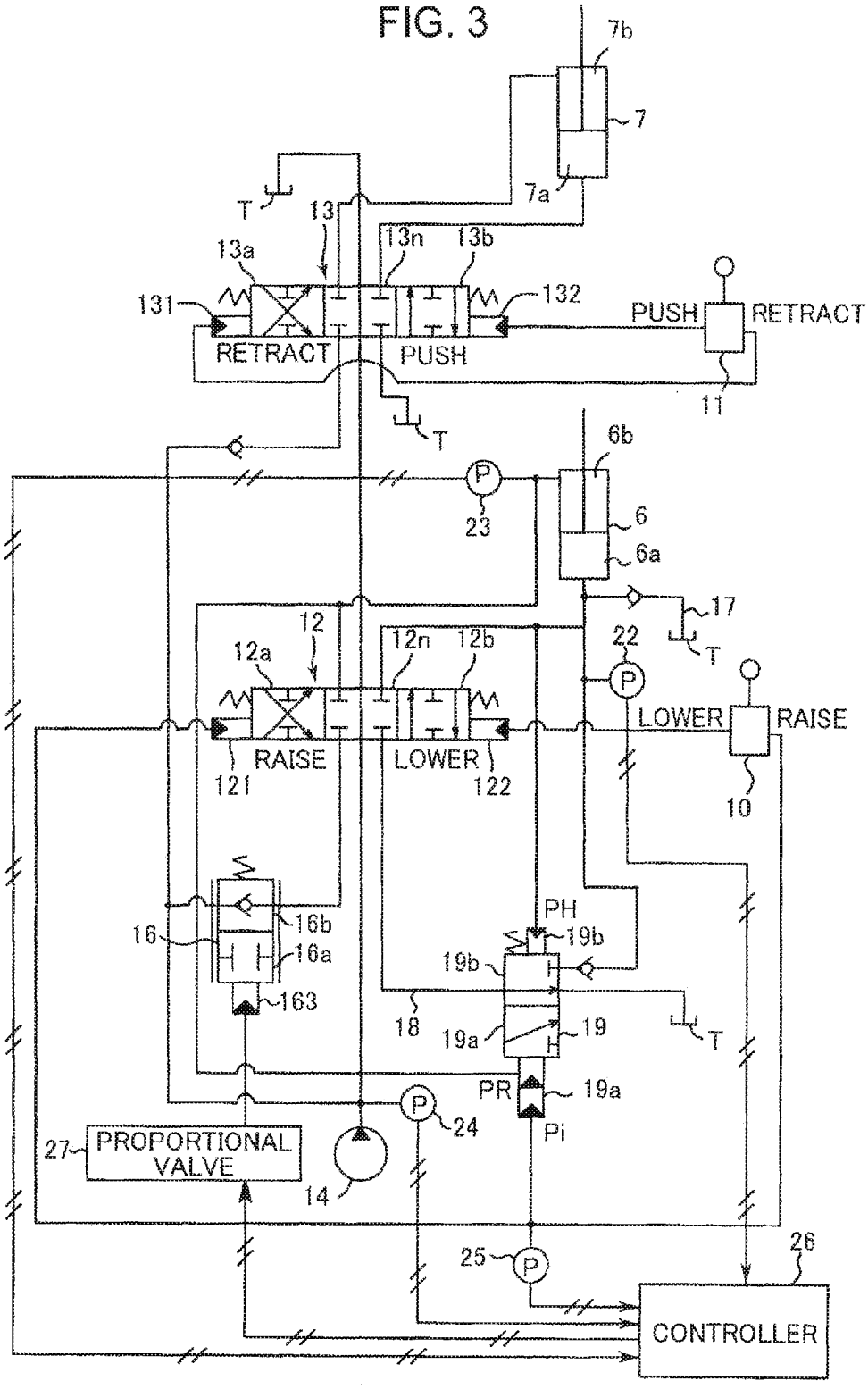
FIG. 3 is a diagram showing a hydraulic circuit according to a third embodiment of the present invention.
Figure 6:
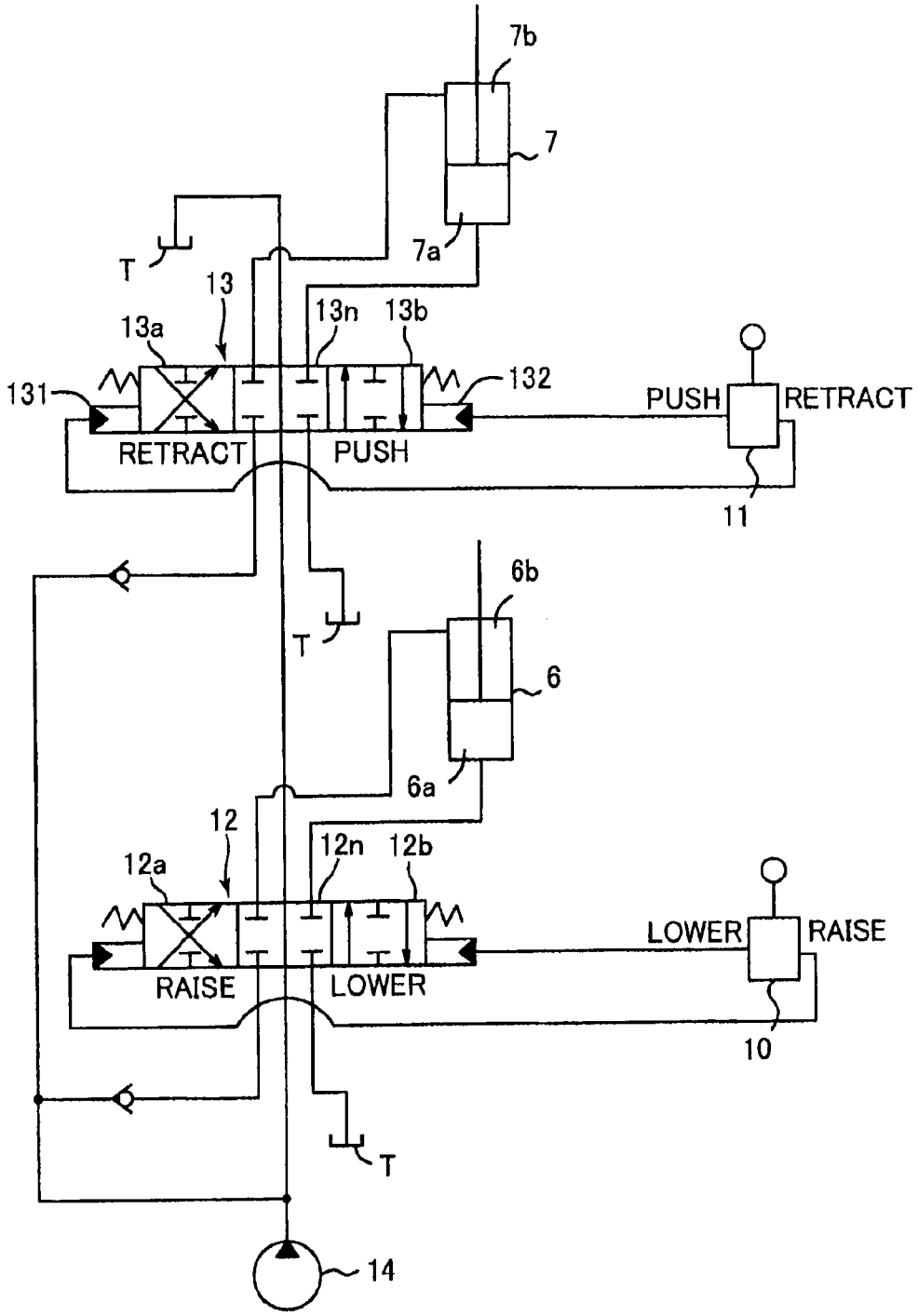
FIG. 6 is a diagram showing a conventional hydraulic circuit installed in a hydraulic shovel.

The hydraulic circuits shown in FIG. 1 to FIG. 3 share the configuration below, similarly to that of the hydraulic circuit shown in FIG. 6.

Figure 5:
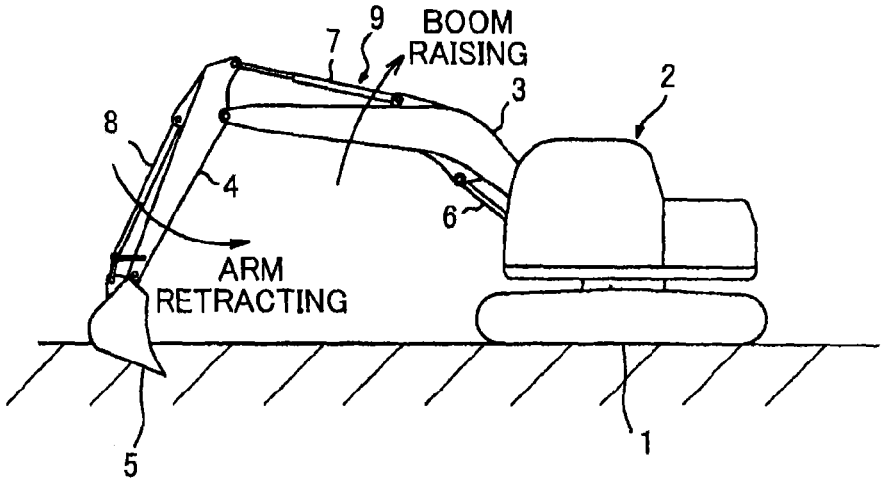
FIG. 5 is a schematic side-view diagram of a hydraulic shovel that is an example in which the present invention is applied.

(A) Each circuit includes: a boom remote control valve 10 and an arm remote control valve 11 which are operated to move the boom 3 and the arm 4 shown in FIG. 5, respectively; a boom control valve 12 and an arm control valve 13 for control of the supply and discharge of pressure fluid to/from the boom cylinder 6 and the arm cylinder 7, respectively, to thereby control the motion of the boom 3 and the arm 4, respectively; a tank T which stores hydraulic fluid; and a hydraulic pump 14 which discharges hydraulic fluid from the tank T. The boom cylinder 6 and the arm cylinder 7 are connected to the shared tank T and the shared hydraulic pump 14 via the boom control valve 12 and the arm control valve 13, respectively. Thus, the arm cylinder 7 corresponds to a "fluid-supplied cylinder" which receives the supply of hydraulic fluid from the hydraulic pump 14 shared by the arm cylinder 7 and the boom cylinder 6; the boom remote control valve 10 and the arm remote control valve 11 make up the first operation device and the second operation device, respectively; and the boom control valve 12 and the arm control valve 13 correspond to the first control valve and the second control valve, respectively.

(B) The remote control valves 10, 11 have respective operation levers and output respective pilot pressures corresponding to the operation of the operation levers to the control valves 12, 13. Each of the control valves 12, 13 comprises a hydraulic-pilot-operated selector valve, which is operated in accordance with the pilot pressure inputted into the hydraulic pilot-operated selector valve. Specifically, the boom control valve 12 has a first pilot port 121 and a second pilot port 122; upon the input of pilot pressure into the first pilot port 121, the boom control valve 12 is switched from a neutral position 12*n* for feeding hydraulic fluid discharged by the hydraulic pump 14 not to the boom cylinder 6 but to the arm control valve 13 to a boom raising position 12*a* for introducing the hydraulic fluid into the head-side fluid chamber 6*a* of the boom cylinder 6 and connecting the rod-side fluid chamber 6*b* of the boom cylinder 6 to the tank T; conversely, upon the input of pilot pressure into the second pilot port 122, the boom control valve 12 is switched from the neutral position 12*n* to a boom lowering position 12*b* for introducing the hydraulic fluid into the rod-side fluid chamber 6*b* and connecting the head-side fluid chamber 6*a* to the tank T. The arm control valve 13 has a first pilot port 131 and a second pilot port 132; upon the input of pilot pressure into the first pilot port 131, the arm control valve 13 is switched from a neutral position 13*n* for letting hydraulic fluid discharged by the hydraulic pump 14 to the tank without feeding the hydraulic fluid to the arm cylinder 7 to a arm retracting position 13*a* for introducing the hydraulic fluid to the head-side fluid chamber 7*a* of the arm cylinder 7 and connecting the rod-side fluid chamber 7*b* of the arm cylinder 7 to the tank T; conversely, upon the input of pilot pressure into the second pilot port 132 the arm control valve 13 is switched from the neutral position 13*n* to the arm pushing position 13*b* for introducing the hydraulic fluid to the rod-side fluid chamber 7*b* and connecting the head-side fluid chamber 7*a* to the tank T.

Next will be explained the features of the hydraulic circuit according to the first embodiment shown in FIG. 1.

The hydraulic circuit according to the first embodiment further comprises, in addition to the various constituent element above, also a flow-rate-control valve 16 and an anti-cavitation circuit 17.

The flow-rate-control valve 16, which comprises a hydraulic-pilot-operated selector valve, is provided in a head-side supply conduit 15 interconnecting the hydraulic pump 14 and the head-side fluid chamber 6*a* of the boom cylinder 6. The flow-rate-control valve 16 operates between a fully-open position 16*b* of maximum opening area and a throttle position 16*a* having a smaller opening area than that of the fully-open position 16*b* (in the present embodiment, the throttle position 16*a* is a maximum-throttle position having the smallest opening area). The fully-open position 16*b* includes a check valve element which prevents hydraulic fluid from backflow from the head-side fluid chamber 6*a* to the hydraulic pump 14.

Specifically, the flow-rate-control valve 16 has a first pilot port 161 and a second pilot port 162. Into the first pilot port 161 is introduced a boom raising pilot pressure Pi outputted from the boom remote control valve 10 and a rod-side pressure PR of the boom cylinder 6, acting so as to urge a spool of the flow-rate-control valve 16 towards the throttle position 16*a*. Into the second pilot port 162 is introduced a head-side pressure PH of the boom cylinder 6, acting so as to urge the spool towards the fully-open position 16*b*. Thus, the flow-rate-control valve 16 is switched to the throttle position 16*a* only upon the boom raising operation (i.e. the rod-side pressure relief operation) in a situation where the rod-side pressure of the boom cylinder 6, i.e., the pressure in the rod-side fluid chamber 6*b*, is higher than the head-side pressure, i.e. the pressure in the head-side fluid chamber 6*a*, while being held at the fully-open position 16*b* in other cases.

The anti-cavitation circuit 17 is provided between the tank T and the head-side fluid chamber 6*a* of the boom cylinder 6 to replenish the head-side fluid chamber 6*a* with hydraulic fluid from the tank T. Specifically, the anti-cavitation circuit 17 includes: a conduit interconnecting the head-side fluid chamber 6*a* and the tank T; and a check valve provided halfway the conduit to prevent hydraulic fluid from inflow into the tank T. Circuits similar to the anti-cavitation circuit 17 are ordinarily provided also in the rod-side fluid chamber 6*b* of the boom cylinder 6 and in both fluid chambers 7*a*, 7*b* of the arm cylinder 7, but these other circuits have been omitted in FIG. 1.

In the present circuit, the flow-rate-control valve 16 is switched to the throttle position 16*a* upon the rod-side pressure relief operation to limit (including block) the fluid supplied to the head-side fluid chamber 6*a* of the boom cylinder 6 from the hydraulic pump 14, thereby allowing the hydraulic fluid discharged by the hydraulic pump 14 to be supplied exclusively, or at a sufficiently large ratio, to the arm cylinder 7. This increases the excavation power by the arm cylinder 7, enhancing work efficiency accordingly. Specifically, upon the rod-side pressure relief operation, that is, when the boom control valve 12 is switched to the boom raising position 12*a* in a situation where the rod-side pressure of the boom cylinder 6, i.e., the pressure in the rod-side fluid chamber 6*b*, is higher than the head-side pressure, i.e., the pressure in the head-side fluid chamber 6*a*, the difference between the pilot pressure inputted at the first pilot port 161 of the flow-rate-control valve 16, i.e. a compound pressure of the pressure PR in the rod-side fluid chamber 6*b* and the pilot pressure for boom raising Pi outputted from the boom remote control valve 10, and the pressure PH in the head-side fluid chamber 6*a* inputted to the second pilot port 162, becomes sufficiently large. The flow-rate-control valve 16 is switched to the throttle position 16*a* by the pressure difference. The limitation of the flow rate of hydraulic fluid at the throttle position 16*a* makes the ratio of hydraulic fluid led to the arm cylinder 7, of the hydraulic fluid discharged by the hydraulic pump 14, be sufficiently increased.

In the circuit according to the first embodiment, moreover, it is possible to operate the flow-rate-control valve 16 to obtain the flow rate limitation effect by utilization of only the pressures of the circuit, namely, the boom raising pilot pressure Pi from the remote control valve 10, and the rod-side pressure PR and the head-side pressure PH of the boom cylinder 6. In short, pure hydraulic control is possible, which enables simplification of the circuits and cost reduction to be achieved.

Although the pressure in the head-side fluid chamber 6*a* of the boom cylinder 6 becomes negative, the occurrence of cavitation can be suppressed by the anti-cavitation circuit 17 supplying hydraulic fluid from the tank T to the head-side fluid chamber 6*a*.

Next will be explained features of a hydraulic circuit according to a second embodiment shown in FIG. 2.

In addition to the effect of the first embodiment, the second embodiment elicits yet more reliable prevention of the pressure in the head-side fluid chamber 6*a* of the boom cylinder 6 from being negative. Specifically, in the first embodiment, the supply of fluid to the head-side fluid chamber 6*a* of the boom cylinder 6 depends only on the sucking action of hydraulic fluid from the tank T by the anti-cavitation circuit 17, which leaves a possibility of negative pressure in the head-side fluid chamber 6*a*; in order to dispel this, the circuit according to the second embodiment further includes a communication valve 19.

The communication valve 19 is made up of a hydraulic-pilot-operated selector valve, similarly to the flow-rate-control valve 16, having a first pilot port 191 and a second pilot port 192. The communication valve 19 is provided in a tank passage 18 interconnecting the boom control valve 12 and the tank T, while being connected to the head-side fluid chamber 6*a* of the boom cylinder 6 via a communicating passage 20. The communicating passage 20 is provided with a check valve 21 for preventing hydraulic fluid from backflow from the head-side fluid chamber 6*a* to the communication valve 19.

The communication valve 19 has a head-side communication position 19*a* for shutting off the tank passage 18 halfway and bringing the boom control valve 12 into communication with the head-side fluid chamber 6*a* of the boom cylinder 6 via the communicating passage 20 and a tank position 19*b* for opening the tank passage 18. Into the first pilot port 191 are introduced the rod-side pressure PR in the boom cylinder 6 and the pilot pressure Pi for boom raising outputted by the boom remote control valve 10, acting so as to urge a spool of the communication valve 19 to the head-side communication position 19*a*. Into the second pilot port 192 is introduced the head-side pressure PH of the boom cylinder 6, acting so as to urge the spool towards the tank position 19*b*. Accordingly, the communication valve 19 is switched to the head-side communication position 19*a* only during the rod-side pressure relief operation, thereby allowing the return fluid from the head-side fluid chamber 6*a* of the boom cylinder 6 to be supplied to the head-side fluid chamber 6*a* of the boom cylinder 6 through the communicating passage 20 and the upstream-side portion of the tank passage 18, that is, performing a regeneration.

In this circuit, during the rod-side pressure relief operation, the communication valve 19 is switched to the head-side communication position 19*a* to enable hydraulic fluid to be replenished from the rod-side fluid chamber 6*b* of the boom cylinder 6 into the head-side fluid chamber 6*a*, that is, regenerated, thus allowing this replenishment to be combined with the replenishment through the suction of the hydraulic fluid by the anti-cavitation circuit 17 from the tank T to thereby enhance the cavitation prevention effect on the head side of the boom cylinder 6. Specifically, during the rod-side pressure relief operation, that is, when the boom control valve 12 is switched to the boom raising position 12*a* in a situation where the rod-side pressure of the boom cylinder 6, i.e., the pressure in the rod-side fluid chamber 6*b*, is higher than the head-side pressure, i.e., the pressure in the head-side fluid chamber 6*a*, the difference between the pilot pressure inputted at the first pilot port 191 of the communication valve 19, i.e., the compound pressure of the pressure PR in the rod-side fluid chamber 6*b* and the pilot pressure Pi for boom raising outputted from the boom remote control valve 10, and the pressure PH in the head-side fluid chamber 6*a* inputted into the second pilot port 192 becomes sufficiently large. This pressure difference switches the communication valve 19 to the head-side communication position 19*a* to bring the boom control valve 12 into communication with the head-side fluid chamber 6*a*. This communication allows hydraulic fluid to be replenished into the head-side fluid chamber 6*a* (regenerated), which excellently enhance the cavitation prevention effect.

Next will be explained features of a hydraulic circuit according to a third embodiment shown in FIG. 3.

In the third embodiment, the prevention of pressure in the head-side fluid chamber 6*a* from being negative is more reliably established than in the second embodiment. In the second embodiment, there is performed replenishment of hydraulic fluid to the head-side fluid chamber 6*a* from the rod-side fluid chamber 6*b* of the boom cylinder 6, that is, regeneration thereof, in order to prevent pressure in the head-side fluid chamber 6*a* from being negative: in this situation, there exists a surface area difference between the fluid chambers 6*a*, 6*b* on account of a piston rod, which makes the flow rate into the head-side fluid chamber 6*a* be insufficient, only with the regeneration flow rate from the rod-side fluid chamber 6*b*, thus generating the requirement of compensating the shortfall by the suction through the anti-cavitation circuit 17. The greater the proportion of suction-mediated replenishment, the higher the likelihood of negative pressure occurring in the head-side fluid chamber 6*a* becomes. Accordingly, the circuit according to the third embodiment is given a function of controlling the opening area (degree of throttling) of the flow-rate-control valve 16 so as to compensate the shortfall of regeneration flow rate from the rod-side fluid chamber 6*b* to the head-side fluid chamber 6*a* with hydraulic fluid passing through the flow-rate-control valve 16 from the hydraulic pump 14.

Specifically, the circuit according to the third embodiment comprises a flow-rate-control valve 16' instead of the flow-rate-control valve 16 according to the second embodiment, and, in addition to the constituent elements of the second embodiment, further comprises: pressure sensors 22, 23, 24, 25 as respective detectors which detect the head-side pressure PH and rod-side pressure PR of the boom cylinder 6, a pump pressure PP, which is the discharge pressure of the hydraulic pump 14, and the pilot pressure for boom raising Pi corresponding to the operation amount of the boom raising operation; a controller 26 which controls the opening area of the flow-rate-control valve 16' on the basis of signals outputted by the pressure sensors 22 to 25; and a proportional valve (electromagnetic proportional pressure reducing valve) 27 that enables the controller 26 to operate the flow-rate-control valve 16'.

The flow-rate-control valve 16' has a throttle position 16*a* and a fully-open position 16*b*, identically to those of the first and second embodiments, while having only a single pilot port 163 as the pilot port, to which the proportional valve 27 is connected. The proportional valve 27 is interposed between a pilot hydraulic source, not shown, and the pilot port 163, such that the secondary pressure of the proportional valve 27, i.e. the pilot pressure inputted at the pilot port 163, is operated according to a control signal outputted by the controller 26. The secondary pressure, i.e. the pilot pressure, acts so as to urge a spool of the flow-rate-control valve 16' towards the throttle position 16*a*, such that the opening area at the flow-rate-control valve 16' changes in accordance with the above pilot pressure. The controller 26 and the proportional valve 27, thus, make up a flow-rate-control device which adjusts the opening area of the flow-rate-control valve 16', on the basis of the pressures PH, PR, PP and Pi detected by the pressure sensors 22 to 25, to thereby control the flow rate.

Figure 4:
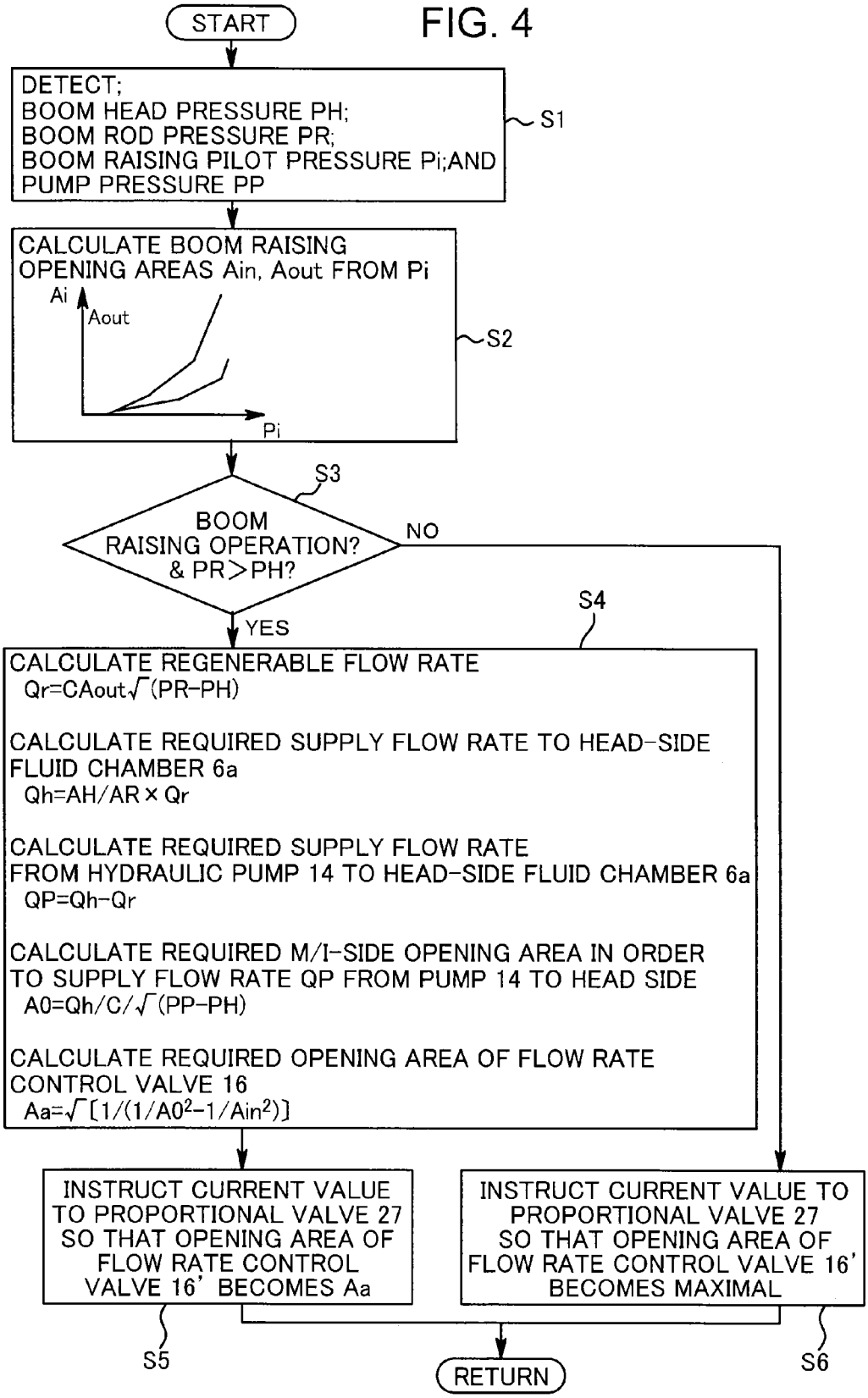
FIG. 4 is a flowchart showing a calculation control operation performed by a controller according to the third embodiment.

Next will be explained a specific calculation control operation performed by the controller 26 with reference to the flowchart of FIG. 4.

In step S1, there are detected the boom head-side pressure PH, the rod-side pressure PR, the boom raising pilot pressure Pi and the pump pressure PP.

In step S2, the controller 26 performs a calculation (1): calculating a meter-in opening area Ain and a meter-out opening area Aout of the boom control valve 12 at the boom raising position 12*a*. This calculation (1) can be performed, for instance, by the controller 26 storing beforehand a map of a relationship between the boom raising pilot pressure Pi and both opening areas Ain, Aout. The operation also may be set to be performed only when step S3 below yields YES.

In step S3, the controller 26 judges whether or not there is a boom raising operation, and the condition rod-side pressure PR>head-side pressure PH is satisfied. If the result is YES, i.e., during the rod-side pressure relief operation, the process proceeds to step S4.

In step S4, the controller 26 performs the following calculations (2) to (6) in addition to the calculation (1) in step S2.

Calculation (2): calculating a flow rate Qr of hydraulic fluid capable of being regenerated from the rod-side fluid chamber 6*b* of the boom cylinder 6 to the head-side fluid chamber 6*a*, according to the expression below, on the basis of the meter-out opening area Aout worked out in step S2, as well as from the head-side pressure PH and the rod-side pressure PR of the boom cylinder 6.

$$Qr=CA\text{out}\sqrt{(PR-PH)}\ (C \text{ is a flow rate coefficient})$$

Calculation (3): calculating a required supply flow rate Qh to the head-side fluid chamber 6*a*, according to the expression below, on the basis of the flow rate of hydraulic fluid that flows out of the rod-side fluid chamber 6*b* of the boom cylinder 6 and on the basis of a cylinder area ratio (AH/AR).

$$Qh=Qr\times AH/AR$$

Calculation (4): calculating a required supply flow rate QP, which is the flow rate of hydraulic fluid required to be supplied from the hydraulic pump 14 to the head-side fluid chamber 6*a* in order to prevent cavitation from occurring in the boom cylinder head-side, according to the expression below.

$$QP=Qh-Qr$$

Calculation (5): calculating a total meter-in opening area AO required in order to supply hydraulic fluid at the flow rate QP from the hydraulic pump 14 to the boom cylinder head-side fluid chamber 6*a*, according to the expression below, from the detected pump pressure PP and head-side pressure PH.

$$AO=Qh/C\sqrt{(PP-PH)}$$

Calculation (6): calculating a required opening area Aa of the flow-rate-control valve 16' which area is required in order to properly limit the total meter-in opening area AO, i.e., the compound opening area of the meter-in opening area Ain of the boom control valve 12 and the opening area of the flow-rate-control valve 16', according to the expression below.

$$Aa=\sqrt{[(1/(1/AO^2-1/Ain^2)]}$$

In step S5, the controller 26 instructs a current value to the proportional valve 27 so as to obtain the opening area Aa.

On the other hand, if step S3 yields NO, i.e., not during a rod-side pressure relief operation, the controller 26, in step S6, instructs a current value to the proportional valve 27 so as to make the opening area of the flow-rate-control valve 16' be maximal, i.e., so as to bring the flow-rate-control valve 16' to the fully-open position 16*b*. This control makes it possible to supply hydraulic fluid at the required flow rate for cavitation avoidance on the head side of the boom cylinder 6 during the rod-side pressure relief operation, thereby allowing head-side cavitation to be prevented more reliably. The flow rate of hydraulic fluid supplied from the hydraulic pump 14 to the arm cylinder 7 is, however, decreased by the supply of a part of the hydraulic fluid discharged by the hydraulic pump 14 to the head-side fluid chamber 6*a* of the boom cylinder 6.

Thus, the flow-rate-control device (the controller 26 and the proportional valve 27 in the present embodiment) includes: a calculation section which performs the calculations (1) to (6) during the boom raising operation in a situation where the rod-side pressure of the boom cylinder 6 is higher than the head-side pressure; and a flow rate operation section which operates the flow-rate-control valve 16' so as to bring the actual opening area in the flow-rate-control valve 16' closer to the required opening area Aa calculated by the calculation section.

The calculation section of the controller 26 is not limited to one that calculates the opening areas Ain, Aout in the boom control valve 12 and the opening area Aa in the flow-rate-control valve 16'. For instance, the calculation section may be one that calculates a target flow rate to be limited by the flow-rate-control valve 16', on the basis of the flow rate to be supplied from the hydraulic pump 14 to the head-side chamber 6*a* and the flow rate in the boom control valve 12 as detected by a flow rate sensor provided at an appropriate site. In this case, the flow rate operation unit of the controller 26 may perform feedback control of the opening area of the flow-rate-control valve 16' (for instance, on the basis of the differential pressure across the flow-rate-control valve 16') so as to obtain the target flow rate calculated by the calculation section.

The above embodiments is explained on the basis of the example of excavating by the arm/boom compound operation which is the most ordinary instance of a boom raising operation in with the high rod-side pressure of the boom cylinder 6 and the low head-side pressure, in other words, on the basis of the configuration wherein the arm cylinder 7 is a fluid-supplied cylinder which receives the supply of the hydraulic fluid from the hydraulic pump 14, together with the boom cylinder 6, and the reaction force which the arm cylinder as the fluid-supplied cylinder receives acts in the direction of raising the boom 3 to increase the pressure in the rod-side fluid chamber 6*b* of the boom cylinder 6 and reduce the pressure in the head-side fluid chamber 6*a*, during the work involving the extension of the arm cylinder 7; however, the present invention is not limited to this. The present invention can also be widely used during other kinds of work such that the boom raising operation is performed in a situation where the reaction force which the working attachment receives acts in the direction of extending the boom cylinder to increase the rod-side pressure and decrease the head-side pressure, such as a excavation work by a bucket/boom compound operation or demolition work by a demolition machine having an attached crushing device as a working device. In short, the "fluid-supplied cylinder" according to the present invention may be the bucket cylinder 8 shown in FIG. 5 or a working device cylinder for driving another working device, such as the above crushing device.

As described above, the present invention provides a construction machine with a working attachment that includes a boom, a boom cylinder and another hydraulic cylinder, wherein a required flow rate at the another hydraulic cylinder can be secured by curtailing the supply of discharge fluid from a hydraulic pump to a head-side fluid chamber of the boom cylinder while relieving a rod-side pressure of the boom cylinder, without incurring significant pressure loss, when the rod-side pressure is increased and the head-side pressure of the boom cylinder is reduced by a reaction force that acts on the working attachment as a result of a boom raising operation.

The construction machine provided by the present invention comprises: a lower traveling body; an upper slewing body installed on the lower traveling body so as to be slewable; a tank which stores hydraulic fluid; a hydraulic pump which discharges hydraulic fluid from the tank; a working attachment attached to the upper slewing body and having a boom, an arm attached to a leading end of the boom, a working device attached to a leading end of the arm, a boom cylinder which actuates the boom, an arm cylinder which actuates the arm, and a working cylinder which actuates the working device, at least one cylinder of the arm cylinder and the working cylinder which is positioned closer to a leading end of the working attachment than the boom cylinder being a fluid-supplied cylinder which receives a supply of hydraulic fluid from the hydraulic pump, together with the boom cylinder, the attachment being arranged so as to receive a reaction force during work involving extension of the fluid-supplied cylinder, the reaction force acting in a direction of raising the boom to thereby increase a rod-side pressure of the boom cylinder and reduce a head-side pressure thereof; a first operation device which is operated to move the boom cylinder; a second operation device which is operated to move the fluid-supplied cylinder; a first control valve which operates in response to the operation of the first operation device to control a motion of the boom cylinder; a second control valve which operates in response to the operation of the second operation device to control a motion of the fluid-supplied cylinder; a flow-rate-limiting section which limits a supply flow rate from the hydraulic pump to a head-side fluid chamber of the boom cylinder, only when an operation for raising the boom is performed in a situation where the rod-side pressure of the boom cylinder is higher than the head-side pressure thereof; and an anti-cavitation circuit for replenishing the head-side fluid chamber of the boom cylinder with hydraulic fluid from the tank.

In this construction machine, during the operation of raising the boom to relieve the rod-side pressure (hereafter also referred to as during the rod-side pressure relief operation) in a situation where the reaction force which the working attachment receives accompanying the operation of extending the fluid-supplied cylinder is supplied (for instance, the operation of drawing the arm towards the front) increases the rod-side pressure of the boom and reduces the head-side pressure, the flow-rate-limiting section limits the flow rate of hydraulic fluid supplied to the head side of the boom cylinder from the hydraulic pump, thereby allowing the hydraulic fluid to be supplied to the fluid-supplied cylinder (for instance, the arm cylinder). This makes it possible to supply to the fluid-supplied cylinder at a sufficient flow rate to secure power and thereby enhance work efficiency. Moreover, the flow-rate-limiting section, performing the limitation of the flow rate only during the rod-side pressure relief operation but not at other times, involves no trouble of raising surplus rod-side pressure during other boom work, differently from the conventional art.

In a preferred example of the present invention, each of the first and second operation devices can include a remote control valve having an operation member to output a pilot pressure corresponding to an operation of the operation member; and the first and second control valves can include respective hydraulic-pilot-operated selector valves which are operated in accordance with respective pilot pressures outputted by the remote control valves that make up the first and second operation devices, respectively. In this case, it is preferable that: the flow-rate-limiting section includes a hydraulic-pilot-operated flow-rate-control valve provided in a head-side supply conduit interconnecting the hydraulic pump and the head-side fluid chamber of the boom cylinder, the hydraulic-pilot-operated flow-rate-control valve having a fully-open position of maximum opening area and a throttle position of smaller opening area than the opening area of the fully-open position; the flow-rate-control valve has a first pilot port into which the rod-side pressure of the boom cylinder and the pilot pressure for boom raising outputted by the remote control valve that makes up the first operation device, and a second pilot port into which the head-side pressure of the boom cylinder is introduced; and the flow-rate-control valve is configured to be switched to the throttle position by a difference between respective pressures introduced into both of the pilot ports, only when an operation of raising the boom is performed in a situation where the rod-side pressure of the boom cylinder is higher than the head-side pressure thereof. The use of the flow-rate-limiting valve makes it possible to switch between flow rate limitation and lifting of the limitation by utilization of only circuit pressures, namely, the boom raising pilot pressure from the remote control valve making up the first operation device and the rod-side pressure and the head-side pressure of the boom cylinder, that is, to perform pure hydraulic control, thereby permitting simplification of the circuits and reduction in costs to be achieved.

More preferably, the construction machine according to the present invention further includes a regeneration circuit for supplying return fluid from a rod-side fluid chamber of the boom cylinder to the head-side fluid chamber of the boom cylinder during the boom raising operation in a situation where the rod-side pressure of the boom cylinder is higher than the head-side pressure thereof. This regeneration circuit enables hydraulic fluid to be supplied to the head-side fluid chamber of the boom cylinder not only by suction of hydraulic fluid from the tank by the anti-cavitation circuit but also by the utilization of the return fluid from the rod side to the head side, that is, by regeneration thereof, thereby permitting the head-side pressure of the boom cylinder to be restrained from being negative pressure.

In the construction machine provided with the regeneration circuit, it is preferable that the construction machine further includes respective detectors which detect the head-side pressure and rod-side pressure of the boom cylinder, a discharge pressure of the hydraulic pump, and an operation amount of the first operation device and a flow-rate-control device which varies the flow rate to be limited by the flow-rate-limiting section, wherein the flow-rate-control device performs: calculating a flow rate of hydraulic fluid which can be regenerated from the rod-side fluid chamber to the head-side fluid chamber of the boom cylinder during the boom raising operation in a situation where the rod-side pressure of the boom cylinder is higher than the head-side pressure thereof; calculating a required flow rate of hydraulic fluid to be supplied to the head-side fluid chamber in accordance with an area ratio of the boom cylinder, on the basis of the flow rate of hydraulic fluid flowing out of the rod-side fluid chamber of the boom cylinder; calculating a required pump flow rate of hydraulic fluid to be supplied from the hydraulic pump to the head-side fluid chamber of the boom cylinder in order to prevent cavitation; calculating a flow rate, or a parameter corresponding thereto, for the flow-rate-limiting section, out of the required pump flow rate; and operating the flow-rate-limiting section so as to obtain a flow rate corresponding to the calculated flow rate or the calculated parameter. The detectors and the flow-rate-control device make it possible to secure a flow rate required for cavitation avoidance on the head side of the boom cylinder and thus reliably prevent cavitation from occurrence.

The invention claimed is:

1. A construction machine, comprising:

a lower traveling body;

an upper slewing body installed on the lower traveling body so as to be slewable;

a tank which stores hydraulic fluid;

a hydraulic pump which discharges hydraulic fluid from the tank;

a working attachment attached to the upper slewing body and having a boom, an arm attached to a leading end of the boom, a working device attached to a leading end of the arm, a boom cylinder which actuates the boom, an arm cylinder which actuates the arm, and a working cylinder which actuates the working device, wherein at least one cylinder of the arm cylinder and the working cylinder is a fluid-supply-target cylinder which, together with the boom cylinder, receives a supply of hydraulic fluid from the hydraulic pump, the fluid-supply-target cylinder being positioned closer to a leading end of the working attachment than the boom cylinder, the attachment being arranged so as to receive a reaction force during work involving extension of the fluid-supply-target cylinder, the reaction force acting in a direction of raising the boom to thereby increase a rod-side pressure of the boom cylinder and reduce a head-side pressure thereof;

a first operation device which is operated to move the boom cylinder;

a second operation device which is operated to move the fluid-supply-target cylinder;

a first control valve which operates in response to the operation of the first operation device to control a motion of the boom cylinder by supplying hydraulic fluid to the head-side fluid chamber of the boom cylinder when an operation for raising the boom is performed;

a second control valve which operates in response to the operation of the second operation device to control a motion of the fluid-supply-target cylinder;

a flow-rate-limiting section which imparts a limitation to a supply flow rate from the hydraulic pump to the head-side fluid chamber of the boom cylinder only when an operation for raising the boom is performed in a situation where the rod-side pressure of the boom cylinder is higher than the head-side pressure thereof, and imparts no limitation to the supply flow rate in a situation where the rod-side pressure of the boom cylinder is equal to the head-side pressure thereof or lower than the head-side pressure thereof; and an anti-cavitation circuit including a conduit directly interconnecting the head-side fluid chamber and the tank so as to bypass the first control valve to replenish the head-side fluid chamber of the boom cylinder with hydraulic fluid from the tank through the conduit bypassing the first control valve, and a single check valve provided at a mid-portion of the conduit to prevent hydraulic fluid from inflow into the tank.

2. The construction machine according to claim 1, wherein the fluid-supply-target cylinder is the arm cylinder, and the flow-rate-limiting section limits the supply flow rate from the hydraulic pump to the head-side fluid chamber of the boom cylinder, during a compound operation of simultaneously performing an arm retracting operation for extending the arm cylinder and a boom raising operation for relieving the rod-side pressure of the boom cylinder caused by a reaction force upon work in the arm retracting operation.

3. The construction machine according to claim 1, further comprising a regeneration circuit for supplying return fluid from a rod-side fluid chamber of the boom cylinder to the head-side fluid chamber of the boom cylinder, during the boom raising operation in a situation where the rod-side pressure of the boom cylinder is higher than the head-side pressure thereof.

4. The construction machine according to claim 3, further comprising: respective detectors which detect the head-side pressure and rod-side pressure of the boom cylinder, a discharge pressure of the hydraulic pump, and an operation amount of the first operation device; and a flow-rate-control device that varies the flow rate to be limited in the flow-rate-limiting section, wherein the flow-rate-control device performs:

calculating a flow rate of hydraulic fluid which can be regenerated from the rod-side fluid chamber to the head-side fluid chamber of the boom cylinder during the boom raising operation in a situation where the rod-side pressure of the boom cylinder is higher than the head-side pressure thereof;

calculating a required flow rate of hydraulic fluid to be supplied to the head-side fluid chamber in accordance with an area ratio of the boom cylinder, on the basis of the flow rate of hydraulic fluid flowing out of the rod-side fluid chamber of the boom cylinder;

calculating a required pump flow rate of hydraulic fluid to be supplied from the hydraulic pump to the head-side fluid chamber of the boom cylinder in order to prevent cavitation;

calculating a flow rate, or a parameter corresponding thereto, for the flow-rate-limiting section, out of the required pump flow rate; and operating the flow-rate-limiting section so as to obtain a flow rate corresponding to the calculated flow rate or the calculated parameter.

5. The construction machine according to claim 1, wherein the flow-rate-limiting section is in a conduit connecting the hydraulic pump to the head-side fluid chamber of the boom cylinder.

6. A construction machine, comprising:

a lower traveling body;

an upper slewing body installed on the lower traveling body so as to be slewable;

a tank which stores hydraulic fluid;

a hydraulic pump which discharges hydraulic fluid from the tank;

a working attachment attached to the upper slewing body and having a boom, an arm attached to a leading end of the boom, a working device attached to a leading end of the arm, a boom cylinder which actuates the boom, an arm cylinder which actuates the arm, and a working cylinder which actuates the working device, wherein at least one cylinder of the arm cylinder and the working cylinder is a fluid-supply-target cylinder which, together with the boom cylinder, receives a supply of hydraulic fluid from the hydraulic pump, the fluid-supply-target cylinder being positioned closer to a leading end of the working attachment than the boom cylinder, the attachment being arranged so as to receive a reaction force during work involving extension of the fluid-supply-target cylinder, the reaction force acting in a direction of raising the boom to thereby increase a rod-side pressure of the boom cylinder and reduce a head-side pressure thereof;

a first operation device which is operated to move the boom cylinder;

a second operation device which is operated to move the fluid-supply-target cylinder;

a first control valve which operates in response to the operation of the first operation device to control a motion of the boom cylinder;

a second control valve which operates in response to the operation of the second operation device to control a motion of the fluid-supply-target cylinder;

a flow-rate-limiting section which imparts a limitation to a supply flow rate from the hydraulic pump to a head-side fluid chamber of the boom cylinder, only when an operation for raising the boom is performed in a situation where the rod-side pressure of the boom cylinder is higher than the head-side pressure thereof, and an anti-cavitation circuit for replenishing the head-side fluid chamber of the boom cylinder with hydraulic fluid from the tank, wherein:

each of the first operation device and the second operation device comprises a remote control valve having an operation member and adapted to output a pilot pressure corresponding to an operation of the operation member;

the first control valve and the second control valve comprise respective hydraulic-pilot-operated selector valves which are operated in accordance with respective pilot pressures outputted by the remote control valves which make up the first operation device and the second operation device, respectively;

the flow-rate-limiting section includes a hydraulic-pilot-operated flow-rate-control valve provided in a head-side supply conduit interconnecting the hydraulic pump and the head-side fluid chamber of the boom cylinder, the hydraulic-pilot-operated flow-rate-control valve having a fully-open position of maximum opening area and a throttle position of smaller opening area than the opening area of the fully-open position;

the flow-rate-control valve has a first pilot port into which the rod-side pressure of the boom cylinder and the pilot pressure for boom raising outputted by the remote control valve that makes up the first operation device are introduced and a second pilot port into which the head-side pressure of the boom cylinder is introduced; and the flow-rate-control valve is configured to be switched to the throttle position by a difference of respective pressures introduced at both of the pilot ports, only when an operation of raising the boom is performed in a situation where the rod-side pressure of the boom cylinder is higher than the head-side pressure thereof.

7. The construction machine according to claim 6, further comprising a regeneration circuit for supplying return fluid from a rod-side fluid chamber of the boom cylinder to the head-side fluid chamber of the boom cylinder, during the boom raising operation in a situation where the rod-side pressure of the boom cylinder is higher than the head-side pressure thereof.

8. The construction machine according to claim 7, further comprising:

respective detectors which detect the head-side pressure and rod-side pressure of the boom cylinder, a discharge pressure of the hydraulic pump, and an operation amount of the first operation device; and a flow-rate-control device that varies the flow rate to be limited in the flow-rate-limiting section, wherein the flow-rate-control device performs:

calculating a flow rate of hydraulic fluid which can be regenerated from the rod-side fluid chamber to the head-side fluid chamber of the boom cylinder during the boom raising operation in a situation where the rod-side pressure of the boom cylinder is higher than the head-side pressure thereof;

calculating a required flow rate of hydraulic fluid to be supplied to the head-side fluid chamber in accordance with an area ratio of the boom cylinder, on the basis of the flow rate of hydraulic fluid flowing out of the rod-side fluid chamber of the boom cylinder;

calculating a required pump flow rate of hydraulic fluid to be supplied from the hydraulic pump to the head-side fluid chamber of the boom cylinder in order to prevent cavitation;

calculating a flow rate, or a parameter corresponding thereto, for the flow-rate-limiting section, out of the required pump flow rate; and operating the flowrate-limiting section so as to obtain a flow rate corresponding to the calculated flow rate or the calculated parameter.

* * * * *